US006320575B1

(12) United States Patent
Terashima et al.

(10) Patent No.: US 6,320,575 B1
(45) Date of Patent: Nov. 20, 2001

(54) MEMORY CONTROLLER AND LIQUID CRYSTAL DISPLAY USING THE MEMORY CONTROLLER

(75) Inventors: Yoshihiro Terashima, Hiratsuka; Yukihiko Sakashita, Kawasaki, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/184,642

(22) Filed: Nov. 3, 1998

(30) Foreign Application Priority Data

Nov. 6, 1997 (JP) ..... 9-304581

(51) Int. Cl.[7] ..... G09G 5/00
(52) U.S. Cl. ..... 345/213; 345/98
(58) Field of Search ..... 345/87, 88, 89, 345/98, 99, 100, 211, 212, 213, 533, 534, 571; 348/169, 251

(56) References Cited

U.S. PATENT DOCUMENTS 5,548,332 * 8/1996 Topper et al. ..... 348/251
5,870,141 * 2/1999 Matsumura et al. ..... 348/169

* cited by examiner

*Primary Examiner*—Xiao Wu
(74) *Attorney, Agent, or Firm*—Fitzpatrick, Cella, Harper & Scinto

(57) ABSTRACT

A memory controller comprises a first counter and a second counter, each having reset and enable functions, a vertical synch signal detector and a horizontal synch signal detector. A reset signal for the first counter is controlled by a signal detected by the vertical synch signal detector. An enable signal for the first counter and a reset signal for the second counter are controlled by a signal detected by the horizontal synch signal detector. An enable signal for the second counter is controlled in accordance with a signal indicating an image effective period. A memory address is controlled by the first and second counters.

4 Claims, 6 Drawing Sheets

MEMORY CONTROLLER AND LIQUID CRYSTAL DISPLAY USING THE MEMORY CONTROLLER

BACKGROUND OF THE INVENTION

1. Field of the Invention

The present invention relates to a memory controller for storing image data of one frame from a personal computer or the like in a memory and then reading the data out of the memory for subsequent use, as well as a liquid crystal display using the memory controller.

2. Description of the Related Art

Hitherto, when storing image data of one frame from a personal computer or the like in a memory, a memory controller constructed as shown in FIG. 5 has been used. In the memory controller shown in FIG. 5, reference numeral 3 denotes a counter for generating a memory address. The counter 3 increments the count value upon receiving an enable signal 10, resets the count value upon receiving a reset signal and increments the clock count upon receiving a clock signal 8. Reference numeral 4 denotes a vertical synch signal detecting block which receives a vertical synch signal 7 for detection of the vertical synch signal, and outputs the reset signal to the counter 3. Reference numeral 6 denotes a frame memory for storing an image signal (not shown) of 1 frame in accordance with the address generated by the counter 3.

Specifically, it has been customary that the address of the memory 6 is generated by incrementing the counter 3 during the effective period of the enable signal 10, which corresponds to the effective period of an input image. Also, the reset signal for the counter 3 is generated upon the vertical synch signal detecting block 4 detecting an edge of the vertical synch signal 7, which is in synch with each frame.

A timing chart for explaining the operation of the memory controller is shown in FIG. 6. Referring to FIG. 6, when a signal XENBL indicating the effective period of image data DATA transitions to a low level, the counter 3 is incremented in synch with the clock signal CLK, which is in turn in synch with the input image. When the signal XENBL transitions to a high level upon reaching the end of data of one line, the counter 3 stops incrementing. Then, when the signal XENBL transitions to a low level again upon the start of image data of next line, the counter 3 once again increments from the point at which counting was stopped. When data of 1 frame is completed, a vertical synch signal VD is input. A signal "xvdrst" is generated from the vertical synch signal VD and a signal vd_s, generated by passing the signal VD through one step of a F/F (Flip/Flop). The memory address is reset only by the signal "xvdrst".

In a memory controller thus constructed, however, if the address generating counter is incremented too much or too little due to an error caused by, e.g., a temporary malfunction of the clock signal, which is supposed to be in synch with the input image, the correct address can no longer be generated until the appearance of the next vertical synch signal after the occurrence of the error. This results in a problem that the image data cannot be correctly written in the memory. This also raises another problem that when reading the image data out of the memory, the image data cannot be read correctly after the occurrence of an error. For example, as shown in FIG. 6, an abnormal condition may occur such that the clock signal CLK enters the counter in an excessive number and that the counter is thereby incremented too much. In such an event, the generated addresses are all out of order after the occurrence of the abnormal condition, and when reading the image data, the data is read out of order.

SUMMARY OF THE INVENTION

An object of the present invention is to provide a memory controller comprising a first counter and a second counter, each having reset and enable functions, a vertical synch signal detector and a horizontal synch signal detector, wherein a reset signal for the first counter is controlled by a signal detected by the vertical synch signal detector, an enable signal for the first counter and a reset signal for the second counter are controlled by a signal detected by the horizontal synch signal detector, an enable signal for the second counter is controlled in accordance with a signal indicating an image effective period, and a memory address is controlled by the first and second counters.

The present invention includes a memory controller in which the image effective period comprises pixels in number $2^n$ (where n is a positive integer), and the number of bits of the second counter is n. The present invention further includes a memory controller in which the signal indicating the image effective period is generated inside of the memory controller on the basis of the horizontal synch signal and applied to the second counter as the enable signal. A liquid crystal display of the present invention advantageously may include any of the memory controllers set forth above.

With the present invention, an error-resistant memory controller can be constructed in which even if correct addresses cannot be produced for a memory due to an error caused by, e.g., a temporary malfunction of a clock signal which is to be input in synch with an image, it is possible to restore the addresses to correct values from a next line because the second counter is reset by the horizontal synch signal.

DETAILED DESCRIPTION OF THE PREFERRED EMBODIMENTS

The present invention will be described below in detail in conjunction with preferred embodiments.

Embodiment 1

A memory controller according to a first embodiment of the present invention will be described below with reference to FIG. 1.

Figure 1:
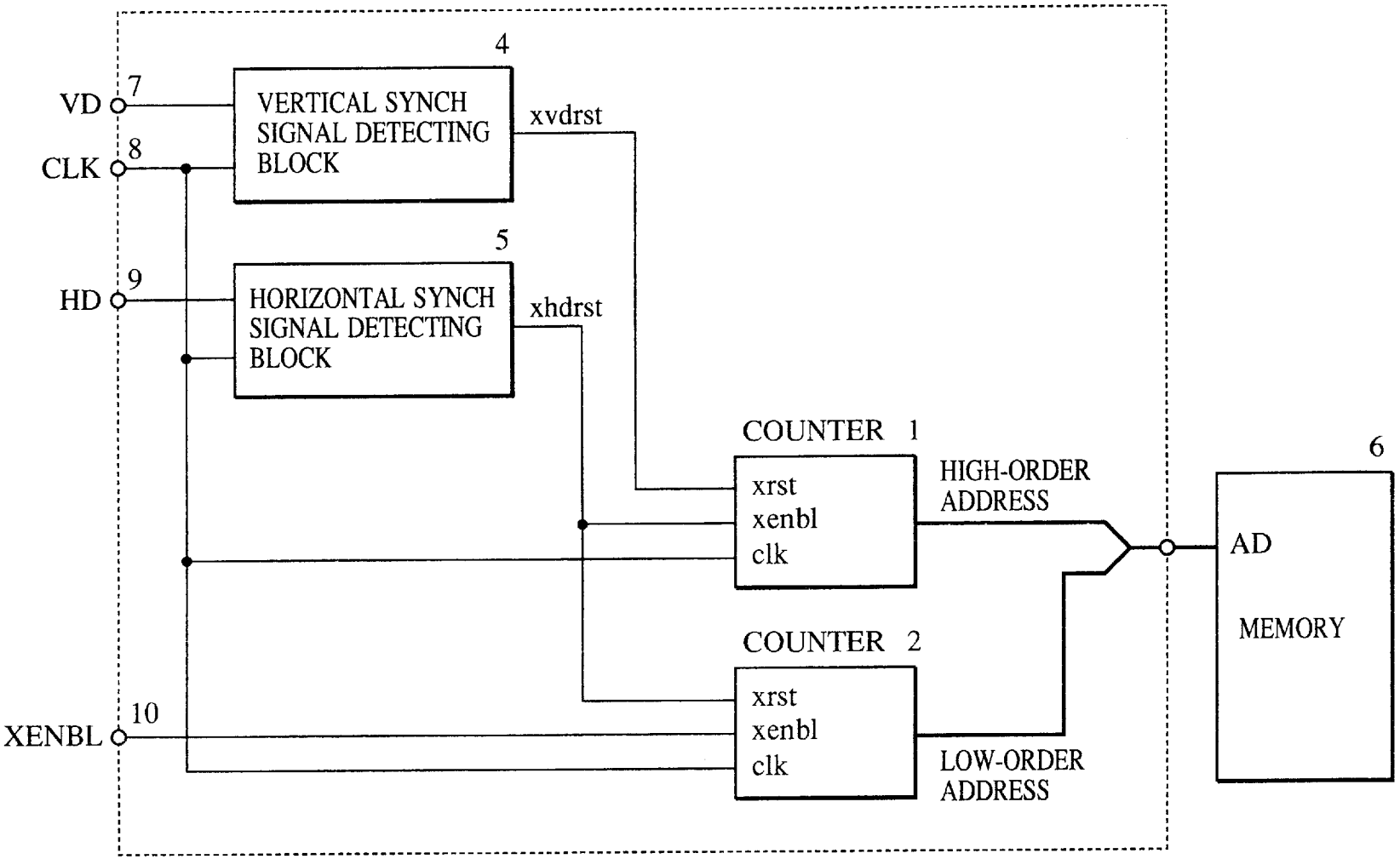
FIG. 1 is a block diagram of one embodiment of a memory controller according to the present invention.

In FIG. 1, reference numeral 1 denotes a counter having a reset terminal, an enable terminal, and a clock terminal. The counter 1 increments the count in response to a clock signal CLK applied to the clock terminal. Reference numeral 2 denotes a second counter having the same function as the counter 1. A vertical synch signal detecting block 4 receives a vertical synch signal VD and the clock signal CLK, and outputs a signal xvdrst, which is applied as a reset signal "xrst" to the counter 1. A horizontal synch signal detecting block 5 receives a horizontal synch signal HD and the clock signal CLK, and outputs a signal xhdrst, which is applied as an enable signal "xenbl" to the counter 1 and an input reset signal "xrst" to the counter 2. A memory 6 stores image data (not shown) in accordance with the address specified by the counters 1, 2. The memory 6 may comprise either a field memory or a frame memory with no limitation in its capacity. Further, reference numeral 7 denotes a vertical synch signal terminal to which the vertical synch signal VD is applied, 9 is a horizontal synch signal terminal to which the horizontal synch signal HD is applied, and 8 is a clock terminal to which the clock signal CLK is applied. Assuming, for example, that an input image has a frame rate 75 Hz in accordance with the VESA standards XGA, the clock signal CLK has a frequency of 78.75 MHZ, but the clock frequency is not limited to that value. Reference numeral 10 denotes an enable terminal to which an image effective period signal XENBL is applied as an enable signal.

The vertical synch signal VD and other signals are supplied from a video signal processing circuit (not shown), and the image data is converted by the video signal processing circuit into digital form, after which it is supplied to the memory 6. The image data stored in the memory 6 is read and used, when instructed, for image signal processing in a frame synchronizer, video editor, and image compression/expansion unit, for example, in accordance with a read enable signal.

Figure 2:
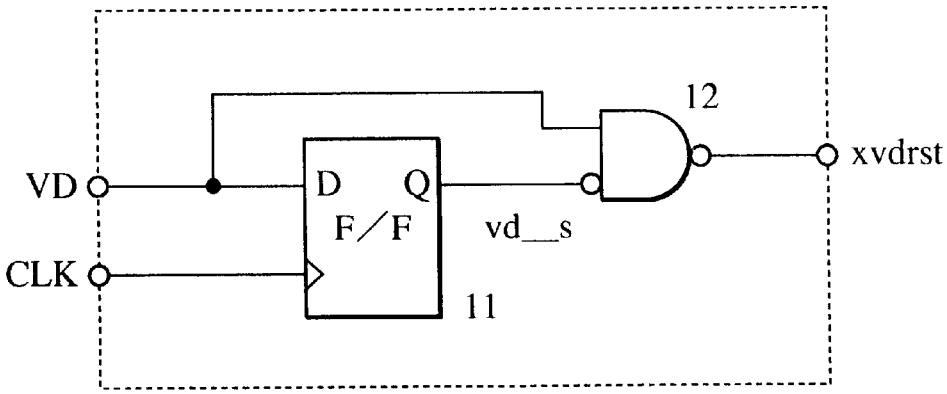
FIG. 2 is a diagram of one embodiment of a synch signal detecting block shown in FIGS. 1 and 5.

In the memory controller shown in FIG. 1, the counter 1 represents a first counter and the counter 2 represents a second counter. The address of the memory 6 is generated by the counters 1 and 2. In this embodiment, it is assumed that the counter 1 controls high-order bits of the memory address which indicate a vertical address of the screen, and the counter 2 controls low-order bits of the memory address which indicate a horizontal address of the screen. The counters 1 and 2 are both incremented in synch with the clock signal CLK which is in turn in synch with the input image. Also, the counters 1 and 2 each have a reset terminal and an enable terminal. Note that the counter reset may be either a synchronous reset or an asynchronous reset. Connected to the reset terminal of the counter 2 is a horizontal reset signal "xhdrst" detected by the horizontal synch signal detecting block 5. Further, the image effective period signal XENBL is connected to the enable terminal of the counter 2. Likewise, connected to the reset terminal of the counter 1 is a vertical reset signal "xvdrst" detected by the vertical synch signal detecting block 4. The vertical synch signal detecting block 4 is constructed, by way of example, as shown in FIG. 2. Further, the horizontal reset signal "xhdrst" is supplied to the enable terminal of the counter 1.

The vertical synch signal detecting block 4, shown in FIG. 2, receives the vertical synch signal VD and the clock signal CLK, and generates a vertical set signal vd_s by passing the vertical synch signal VD through one step of the F/F (Flip/Flop) 11. The logical product of the vertical synch signal VD and an inverted signal of the vertical set signal vd_s, which is resulted by passing the vertical synch signal VD through one step of the F/F 11, is produced by a logical gate 12 and then output as the vertical reset signal "xvdrst" from the logical gate 12. The horizontal synch signal detecting block 5 can output the horizontal reset signal with a similar construction as the vertical synch signal detecting block 4. Of course, the construction of each block is not limited to the illustrated one.

Figure 3:
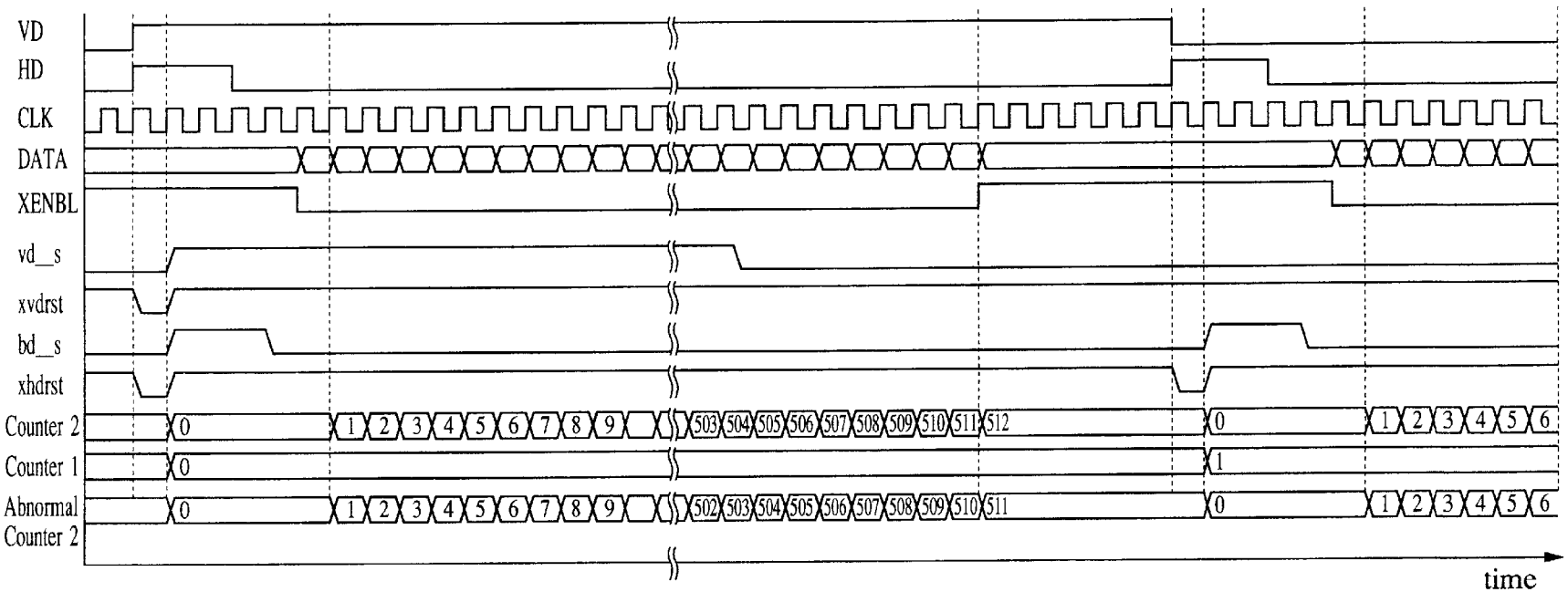
FIG. 3 is a timing chart of the memory controller shown in FIG. 1.

FIG. 3 is a timing chart for explaining the operation of the memory controller shown in FIG. 1. In FIG. 3, when the image effective period signal XENBL transitions to a low level after a blanking period succeeding to a rising edge of the vertical synch signal, the counter 2 starts incrementing in synch with the clock signal CLK, which is in turn in synch with the input image. When the image effective period signal XENBL turns to a high level upon reaching the end of data of one line (corresponding to an entire period in which the counter 2 counts up from 1 to 512), the counter 2 stops increment. Prior to the start of inputting of next line data, the horizontal synch signal HD is input. The horizontal synch signal HD is passed through one step of the F/F to produce a signal hd_s. When the horizontal synch signal HD is at a high level and the signal hd_s, which results from passing the horizontal synch signal HD through one step of F/F, is at a low level, the horizontal reset signal "xhdrst" takes on a low level.

The horizontal reset signal "xhdrst" is produced in synch with the clock in this embodiment, but it need not be in synch with the clock. When the horizontal reset signal "xhdrst" is at a low level, the counter 2 is reset and the counter 1 is incremented by one. Then, when the image effective period signal XENBL turns next to a low level, the counter 2 starts incrementing of the low-order address from 0 again. In this way, each time the horizontal synch signal HD is input, the counter 2 is reset and the counter 1 is repeatedly incremented by one. When data of one frame is completed, the vertical synch signal VD is input. The vertical synch signal VD is passed through one step of the F/F to produce a signal vd_s. When the vertical synch signal VD is at a high level and the signal vd_s is at a low level, the vertical reset signal "xvdrst" takes on a low level.

Supposing now that the clock signal CLK, which is normally in synch with the input image, occurs out of order and one clock signal is missed in comparison with the normal condition. In that situation, the memory address is incremented by one less than it should be, as shown at "Abnormal Counter 2" in FIG. 3. However, in the present invention, abnormal addresses occur only in that line. Because the counter 2 is reset by the horizontal synch signal HD, the memory addresses have correct values in a next line. Also, such an error does not affect the counter 1.

Likewise, if the clock signal CLK counts too much, the error is limited only to the line at which the error occurred, and correct values are counted from the next line. Such an error also does not affect the counter 1.

Additionally, the vertical reset signal "xvdrst" is produced in synch with the clock in this embodiment. However, it need not be in synch with the clock. When the vertical reset signal "xvdrst" is at a low level, the counters 1 and 2 are both reset.

In the above construction, when the number of effective pixels in one line is $2^n$, and the second counter has n bits, the memory addresses can be produced in full n-bit notation and therefore the memory can be utilized with maximum efficiency. Where an image of one frame consists of 1280 (H)×1024 (V) pixels, for example, the memory can be fully utilized in the vertical direction since the number of pixels in the vertical direction is expressed by $2^{10}$.

The above-mentioned image effective period signal XENBL may be generated inside the memory controller on the basis of the horizontal synch signal.

For a memory having addresses each comprised of two addresses, e.g., a column address and a row address, the present invention can also be practiced with a similar advantage by dividing the combined address of those two addresses into two pars which can be each expressed in an arbitrary number of bits, and then controlling the above two counters to produce the respective address parts.

This embodiment may be modified such that the first counter controls the low-order memory address and the second counter controls the high-order memory address. This modification can also provide similar advantages.

Moreover, there is no limitation in the manner of combining the numbers of bits of the first and second counters with each other to become equal to the number of address bits of the memory. A similar advantage can be provided no matter how individual bits of the first and second counters are allocated to respective address bits of the memory so long as the allocated bits are not overlapped with each other.

Embodiment 2

Figure 4:
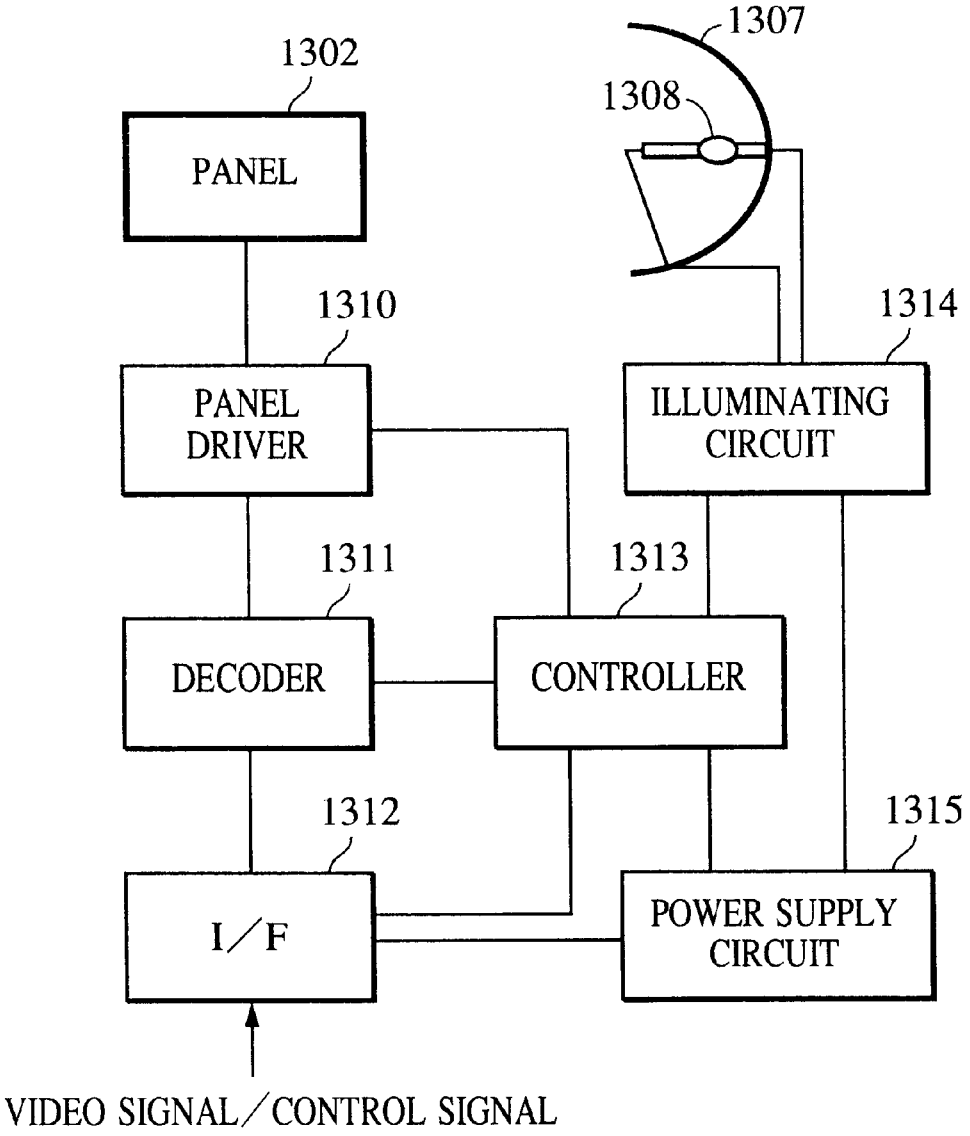
FIG. 4 is a block diagram of a projection type liquid crystal display in which the memory controller according to the present invention is employed.
Figure 5:
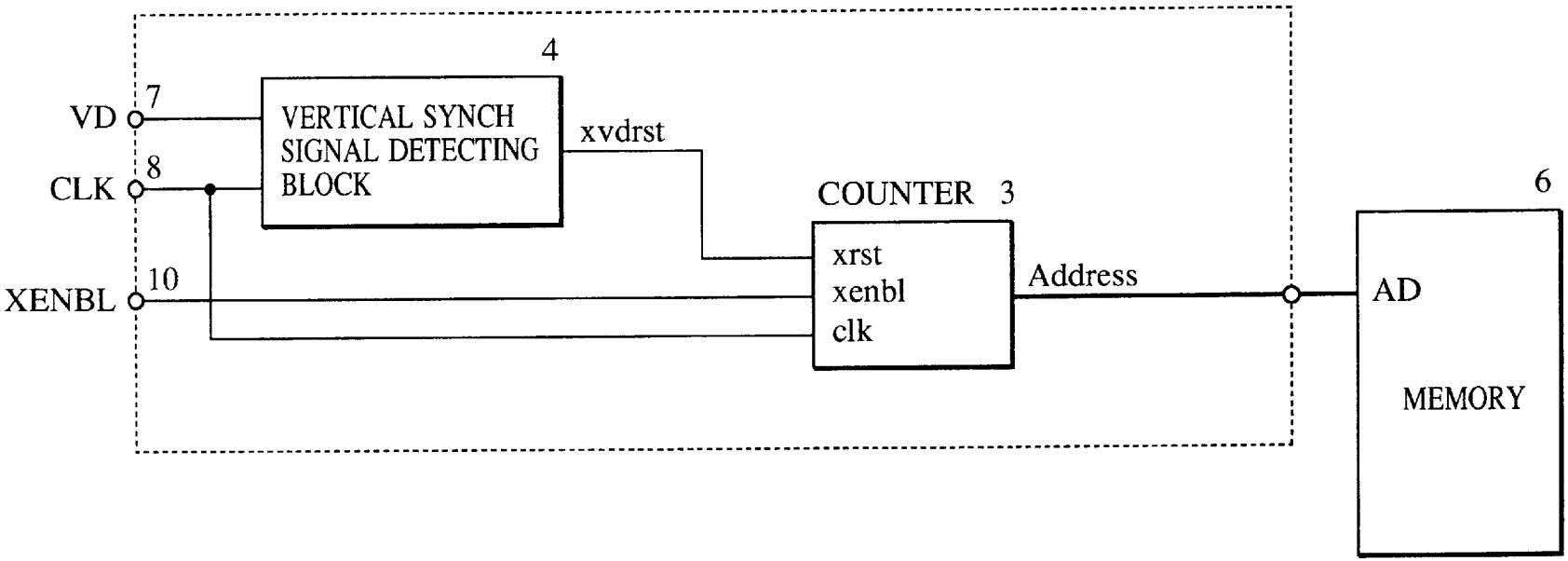
FIG. 5 PRIOR ART
FIG. 5 is a block diagram of a conventional memory controller.
Figure 6:
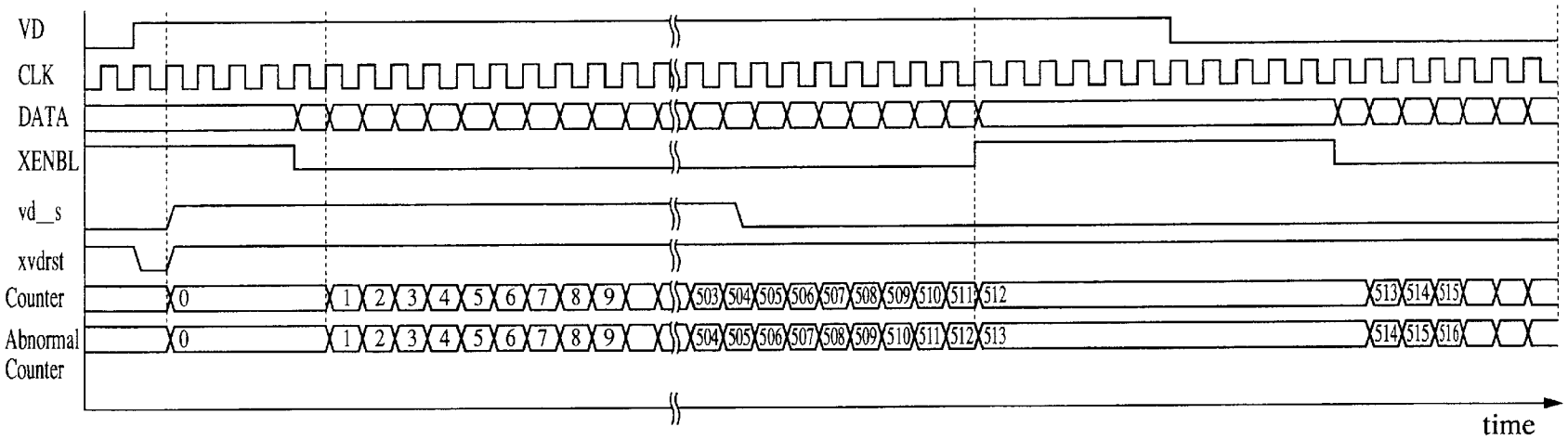
FIG. 6 PRIOR ART
FIG. 6 is a timing chart of the memory controller shown in FIG. 5.

FIG. 4 is a block diagram of a second embodiment according to the present invention in which the memory controller described above is employed in a drive circuit system of a projection type liquid crystal display. In FIG. 4, reference numeral 1310 denotes a panel driver which has functions of reversing the polarity of an RGB video signal, forming a liquid crystal drive signal of which voltage is amplified to a predetermined level, and forming a drive signal for counter electrodes, various timing signals, etc. An interface (I/F) 1312 decodes various video signals and controls transmission signals into standard video signals, etc.

Reference numeral 1311 denotes a decoder for decoding and converting the standard video signals from the interface 1312 into RGB primary-color video signals and synch signals, i.e., image signals adapted for a liquid crystal panel 1302. Further, the memory of the memory controller described in the above first embodiment can be utilized to display results of editing functions, such as wiping, fading-in and fading-out, on the liquid crystal panel. A ballast illuminating circuit 1314 energizes an arc lamp 1308 in an elliptical reflector 1307 for illuminating the display. A power supply circuit 1315 supplies electric power to the associated circuit blocks. Reference numeral 1313 denotes a controller which includes a console (not shown) and controls the associated circuit blocks in an overall coordinated manner. Thus, the projection type liquid crystal display of this embodiment employs a quite general drive circuit system for a single-plate projector, and hence can display a color image with good quality, free from the above-mentioned problem of RGB mosaic without causing an additional burden on the drive circuit system.

According to the present invention, as described above, even when the clock signal, which is supposed to be in synch with the input image, occurs out of order and the memory address is incremented too much or too little, the memory controller can produce normal addresses after a next horizontal synch signal, and therefore memory control can be achieved with the effect of such an error minimized.

What is claimed is:

1. A memory controller comprising a first counter and a second counter, each having reset and enable functions, a vertical synch signal detector and a horizontal synch signal detector, wherein a reset signal for said first counter is controlled by a signal detected by said vertical synch signal detector, an enable signal for said first counter and a reset signal for said second counter are controlled by a signal detected by said horizontal synch signal detector, an enable signal for said second counter is controlled in accordance with a signal indicating an image effective period, and a memory address is controlled by said first and second counters, wherein when the signal indicating an image effective period is LOW, said second counter starts to increment, carries out an increment of one line, and, when the signal indicating an image effective period is HIGH, finishes the increment, and before data input of next line starts, a horizontal synch signal is inputted into said second counter, and then when the reset signal is LOW, said second counter is reset and said first counter starts to increment, and next, when the signal indicating an image effective period is LOW, said second counter starts to increment again.

2. The memory controller according to claim 1, wherein said image effective period comprises pixels in number $2^n$, where n is a positive integer, and the number of bits of the second counter is n.

3. The memory controller according to claim 1, wherein the signal indicating said image effective period is generated inside said memory controller on the basis of said horizontal synch signal and applied to said second counter as the enable signal.

4. A liquid crystal display including the memory controller according to any one of claims 1 to 3.

* * * * *

UNITED STATES PATENT AND TRADEMARK OFFICE

CERTIFICATE OF CORRECTION

PATENT NO. : 6,320,575 B1
DATED : November 20, 2001
INVENTOR(S) : Yoshihiro Terashima et al.

It is certified that error appears in the above-identified patent and that said Letters Patent is hereby corrected as shown below:

Column 4,
Line 65, "pars" should read -- parts --.

Signed and Sealed this

Seventh Day of May 2002

*Attest:*

*Attesting Officer*

JAMES E. ROGAN
*Director of the United States Patent and Trademark Office*